US007615143B2

(12) United States Patent
Chen et al.

(10) Patent No.: US 7,615,143 B2
(45) Date of Patent: Nov. 10, 2009

(54) HYDROTHERMALLY STABLE CATALYST AND ITS USE IN CATALYTIC CRACKING

(75) Inventors: Tan-Jen Chen, Kingwood, TX (US); Paul F. Keusenkothen, Houston, TX (US); J. Jason Wu, Clinton, NJ (US); John Scott Buchanan, Lambertville, NJ (US); Guang Cao, Branchburg, NJ (US); Larry L. Iaccino, Seabrook, TX (US); David L. Stern, Baton Rouge, LA (US); Matthew J. Vincent, Baytown, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 397 days.

(21) Appl. No.: 10/903,152

(22) Filed: Jul. 30, 2004

(65) Prior Publication Data

US 2006/0021912 A1 Feb. 2, 2006

(51) Int. Cl.
*C10G 11/05* (2006.01)

(52) U.S. Cl. ..... 208/120.01; 208/113; 208/114; 208/118; 208/120.1; 208/120.15; 585/653

(58) Field of Classification Search ..... 208/120.01, 208/120.1, 120.15, 113, 114, 118, 120.04; 585/653

See application file for complete search history.

(56) References Cited

U.S. PATENT DOCUMENTS

| | | | | |
|---|---|---|---|---|
| 4,594,146 | A | 6/1986 | Chester et al. | |
| 4,608,355 | A | 8/1986 | Chu | |
| 4,962,075 | A | 10/1990 | Green et al. | |
| 4,973,399 | A | 11/1990 | Green et al. | |
| 4,980,052 | A | 12/1990 | Green et al. | |
| 5,409,595 | A * | 4/1995 | Harandi et al. | 208/60 |
| 5,486,284 | A * | 1/1996 | Degnan et al. | 208/120.15 |
| 5,779,882 | A * | 7/1998 | Chester et al. | 208/120.01 |
| 5,968,342 | A | 10/1999 | Tsunoda et al. | |
| 6,051,520 | A | 4/2000 | Wu et al. | |
| 6,080,698 | A | 6/2000 | Zhang et al. | |
| 6,093,671 | A | 7/2000 | Wu et al. | |
| 6,136,290 | A | 10/2000 | Benazzi et al. | |
| 6,160,191 | A | 12/2000 | Smith et al. | |
| 6,303,839 | B1 * | 10/2001 | Marker | 585/313 |
| 6,307,117 | B1 | 10/2001 | Tsunoda et al. | |
| 2002/0056662 | A1 | 5/2002 | Quesada et al. | |
| 2002/0189973 | A1 * | 12/2002 | Henry et al. | 208/74 |
| 2003/0121827 | A1 * | 7/2003 | van den Berge et al. | 208/120.01 |
| 2003/0173254 | A1 | 9/2003 | Chen et al. | |

FOREIGN PATENT DOCUMENTS

| | | |
|---|---|---|
| CN | 1317543 | 10/2001 |
| EP | 0 186 398 | 7/1986 |
| EP | 0 109 059 B1 | 7/1987 |
| JP | 59152334 | 8/1984 |
| JP | 61007218 | 1/1986 |
| JP | 2001413 | 1/1990 |

* cited by examiner

*Primary Examiner*—Glenn Caldarola
*Assistant Examiner*—Prem C. Singh

(57) ABSTRACT

There is provided a catalyst composition having improved hydrothermal stability for the catalytic cracking of a hydrocarbon feedstock to selectively produce propylene. The catalyst composition comprises a first crystalline molecular sieve selected from the group consisting of IM-5, MWW, ITH, FER, MFS, AEL, and AFO and an effective amount of a stabilization metal (copper, zirconium, or mixtures thereof) exchanged into the molecular sieve. The catalyst finds application in the cracking of naphtha and heavy hydrocarbon feedstocks. When used in the catalytic cracking of heavier hydrocarbon feedstocks, the catalyst composition preferably comprises a second molecular sieve having a pore size that is greater than the pore size of the first molecular sieve. The process is carried out by contacting a feedstock containing hydrocarbons having at least 4 carbon atoms is contacted, under catalytic cracking conditions, with the catalyst composition.

28 Claims, No Drawings

HYDROTHERMALLY STABLE CATALYST AND ITS USE IN CATALYTIC CRACKING

FIELD OF THE INVENTION

This invention relates to catalysts having improved hydrothermal stability which find particular application in the catalytic cracking of hydrocarbon feedstocks to produce enhanced yields of propylene.

BACKGROUND TO THE INVENTION

The need for low emissions has created an increased demand for light olefins for use in alkylation, oligomerization, and MTBE and ETBE synthesis processes. In addition, a low cost supply of light olefins, particularly propylene, continues to be in demand as feedstock for polypropylene production.

Light olefins, such as ethylene and propylene, can be produced by thermally cracking naphtha feedstocks containing paraffinic and isoparaffinic compounds, naphthenes and aromatics to produce light olefins. The thermal cracking of naphtha is carried out by exposing naphtha and steam to relatively high temperatures in the tubular coils of a fired heater. A problem associated with this technique is that the process is energy intensive, not very selective, produces coke, and releases significant amounts of carbon dioxide into the air.

Another technique for producing light olefins involves the catalytic cracking of hydrocarbons, such as naphtha or a butene-containing feed. In the catalytic cracking of naphtha or a butene-containing feed, the process is carried out by contacting the naphtha or butene-containing feed with a catalyst usually comprised of one or more crystalline microporous molecular sieves to selectively convert the feed into an olefin-containing mixture. Although various naphtha and butene catalytic cracking processes have been proposed in the past, many of the processes do not produce commercially important light olefins, e.g., propylene, with sufficient selectivity or yield. Also, the processes can produce undesirable amounts of methane and aromatics as unwanted byproducts. In contrast, a practical and economic butene or naphtha catalytic cracking process should selectively produce increased amounts of light olefins, e.g., propylene, while producing minimal amounts of methane and aromatics.

Fluid catalytic cracking (FCC) is routinely used to convert heavy hydrocarbon feedstocks to lighter products, such as gasoline and distillate range fractions. Conventional processes for catalytic cracking of heavy hydrocarbon feedstocks to gasoline and distillate fractions typically use a catalyst containing a large pore molecular sieve, such as zeolite Y, as the primary cracking component and, optionally, an intermediate pore size molecular sieve, such as ZSM-5. While FCC is an efficient process for converting heavier feed to lighter products, many times the process makes less than desirable amounts of light olefins, e.g., propylene.

One problem which has persisted with molecular sieve, e.g., zeolite, catalysts is that of hydrothermal stability. In many of the processes in which they are used, the molecular sieves are exposed to water vapor at elevated temperatures and this tends to reduce the activity of the molecular sieve because of the loss of acidic sites through dehydroxylation and dealuminization, the loss being manifested by a decrease of the alpha value of the molecular sieve. The alpha value is a measure of the ability of the molecular sieve in cracking of paraffins. In some cases, particularly with zeolites having a low silica to alumina ratio, crystallinity may be adversely affected. Different molecular sieves exhibit different degrees of hydrothermal stability, but the problem is encountered to some extent with all of them. The exposure to the water vapor may occur during the catalytic process itself or in an ancillary treatment step. For example, in processes such as catalytic cracking, steam stripping, which is used to remove occluded hydrocarbons from the catalyst prior to regeneration, can cause a reduction of activity of the catalyst, as will any steam which is present in the regeneration and which has been produced either by combustion of any hydrocarbon material on the catalyst itself or by the combustion of hydrocarbon fuel used to heat the regenerator. The deleterious effect of the steam becomes more pronounced the longer and more frequent the exposure to it is; processes in which the catalyst is continuously or continually exposed to steam therefore present greater problems than those where the contact is occasional or at very long intervals. For instance, in FCC units the catalyst is continuously circulated through the reactor and the regenerator and comes into contact with steam during each complete cycle when the catalyst is subjected to the stripping and regeneration steps.

Attempts to improve the hydrothermal stability of molecular sieves have often been made and have met with varying success. Moreover, although it has often been found possible to improve the hydrothermal stability, other properties of the molecular sieve may be adversely affected. For example, the rare earth form of faujasite zeolite has improved hydrothermal stability, but the activity of the zeolite in the rare earth form may not be as great as it would be in other forms. Moreover, producing the rare earth form of a molecular sieve may not always be a practicable method to improve its hydrothermal stability. For example, rare earth cations do not readily enter the structure of some molecular sieves because of the low ion exchange selectivity of these cations.

The present invention provides catalysts having improved hydrothermal stability and processes for the catalytic cracking of hydrocarbon feedstocks, e.g. naphtha and heavier hydrocarbon feedstocks, which are effective in producing enhanced yields of propylene, as compared with known processes used to crack hydrocarbons.

SUMMARY OF THE INVENTION

In accordance with the present invention, there is provided a catalyst composition having improved hydrothermal stability that finds particular application in the catalytic cracking of a feedstock hydrocarbons, such as naphtha, to selectively produce propylene or with in combination with a larger pore molecular sieve in the catalytic cracking of heavier hydrocarbon feedstocks. The catalyst composition contains a first crystalline molecular sieve selected from the group consisting of IM-5, MWW, ITH, FER, MFS, AEL, and AFO and an effective amount of a stabilization metal selected from the group consisting of copper, zirconium, and mixtures thereof exchanged into the molecular sieve. When used in the catalytic cracking of heavier hydrocarbon feedstocks, the catalyst will preferably further comprise a second molecular sieve that preferably has a pore size that is larger that the pore size of the first crystalline molecular sieve.

In another embodiment, the present invention provides a process for catalytically cracking a hydrocarbon feedstock to selectively produce $C_3$ olefins. The process is carried out by contacting a hydrocarbon feedstock containing hydrocarbons having at least 4 carbon atoms under catalytic cracking conditions and in the presence of a catalyst composition comprising the first crystalline molecular sieve and an effective amount of the stabilization metal.

In one preferred embodiment, the feedstock used in the process comprises a naphtha or butene-containing feed having a boiling range of about 25° C. to about 225° C.

In a further preferred embodiment, the feedstock used in the process comprises hydrocarbon mixture having an initial boiling point of at least 200° C. and the catalyst comprises first and second molecular sieves.

DETAILED DESCRIPTION OF THE INVENTION

Catalyst Composition

Examples of first molecular sieve useful in the catalyst composition include IM-5 (disclosed in U.S. Pat. No. 6,306,286), MWW structure type molecular sieve, e.g., MCM-22, SSZ-25, PSH-3, and other members of the MCM-22 family of molecular sieves, e.g., MCM-36, MCM-49, and MCM-56. The MCM-22 type materials may be considered to contain a similar common layered structure unit. Other molecular sieves suitable for use include ITH structure type molecular sieve e.g., ITQ-13, FER structure type molecular sieve, e.g., ZSM-35, MFS structure type molecular sieve, e.g., ZSM-57, AEL structure type molecular sieve, e.g., SAPO-11, and AFO structure type molecular sieve, e.g., SAPO-41. These molecular sieves are described in *Atlas of Zeolite Framework Types,* eds. Ch. Baerlocher, W. H. Meier, and D. H. Olson, Elsevier, Fifth Edition, 2001, which is hereby incorporated by reference. Preferably, the catalyst composition contains MCM-49.

The average particle size of the crystals of the first molecular sieve will vary. Generally the average particle size will be in the range of from about 0.05 to about 5 microns. Preferably, the average particle size will be from about 0.1 to about 3 microns, and, most preferably, the average particle size will be about 0.2 microns.

The expression "average particle size" as used herein, means the arithmetic average of the diameter distribution of the particle on a volume basis.

When the first molecular sieve is a zeolitic-type molecular sieve, the molecular sieve will comprise compositions that have the following molar relationship:

$$X_2O_3:(n)\,YO_2,$$

wherein X is a trivalent element, such as boron, aluminum, iron, and/or gallium, Y is a tetravalent element such as silicon, tin, and/or germanium, and n has a value of at least 2, said value being dependent upon the particular type of molecular sieve and the trivalent element present in the molecular sieve.

The stabilization metal (copper, zirconium, or mixtures thereof) may be introduced into the molecular sieve by the use of any soluble salt of the stabilization metal. Examples of suitable zirconium salts include, but are not limited to, zirconium acetate, zirconium formate, zirconium citrate, zirconium ammonium fluoride, and zirconium nitrate. Examples of suitable copper salts include, but are not limited to, cupric chloride, cupric bromide, cupric iodide, and cupric ethoxide. The preferred soluble salt for copper is a soluble copper salt that provides cupric ions such as cupric fluoride and cupric nitrate. When a copper complex, such as $[CuCl_4]^{2-}$, is used, the copper must be oxidized to the desired cationic form.

The stabilization metal can be introduced into the molecular sieve by ion-exchange and incipient wetness. In a preferred embodiment, the stabilization metal is ion exchanged into the first molecular sieve. Preferably, the molecular sieve undergoes at least two ion exchange treatments.

After introducing the stabilization metal, the molecular sieve can be washed with a suitable washing medium such as water, acetone or alcohol. The washed material may be dried at temperatures sufficient to remove the washing medium without deleteriously affecting the zeolite framework. Thereafter, the stabilization metal-containing molecular sieve can be calcined in a suitable inert atmosphere such as $N_2$, He, or an oxygen containing medium such as air, at temperatures ranging from 200° C. to 800° C., preferably 350° to 550° C., for a period of time sufficient to remove volatile materials and oxidize the stabilization metal, e.g., 0.01 to 168 hours, preferably 0.1 to 8 hours.

A preferred procedure for introducing copper into the molecular sieve comprises contacting the molecular sieve at reflux temperature with about 25 ml per gram of an aqueous solution containing the cupric salt in a concentration of 0.01 to 5 moles per liter of water. Contact is maintained for 0.01 to 168 hours, preferably 0.1 to 8 hours. This procedure may be repeated one or more times using fresh ion exchange medium. In washing the final molecular sieve product with distilled water to remove extraneous salts, care should be taken to avoid overwashing and consequent $H^+$ exchange of the copper cation-containing product. Advantageously, the pH of the washing water is preferably greater than 2.

Preferably, the first molecular sieve will contain at least 0.1 weight percent of the stabilization metal cations based on the weight of the molecular sieve, and more preferably will contain at least 0.50 weight percent of the stabilization metal cations. The maximum loading will be set by the nature of the molecular sieve and the method by which the stabilization metal is incorporated into the molecular sieve. If ion exchange is used, the maximum loading will be set by the exchange capacity of the molecular sieve which, in turn, is a function of tetravalent, e.g., silica, trivalent metal, e.g., alumina, ratio. Because acidic sites will normally be desired in the molecular sieve in order to confer activity, the proportion of available sites occupied by the stabilization metal cations will be appreciably below the total. If the stabilization metal is incorporated by impregnation, the exchange capacity of the molecular sieve will impose no fundamental limitation on the loading but other factors, such as sorption of the copper containing species, may do so. The amount of stabilization metal incorporated into the molecular sieve will therefore tend to be of the same order, regardless of the method of incorporation. Generally, the maximum loading will be 10 weight percent and, more usually, 5 weight percent of stabilization metal cations, based on the weight of the molecular sieve.

Preferably, the catalyst composition includes phosphorus or phosphorus-containing compounds to increase its stability. Incorporation of phosphorus can be accomplished by contacting the molecular sieve with a solution of the appropriate phosphorus compound, followed by drying and calcining to convert the phosphorus to its oxide form.

Representative phosphorus-containing compounds include derivatives of groups represented by $PX_3$, $RPX_2$, $R_2PX$, $R_3P$, $X_3PO$, $(XO)_3PO$, $(XO)_3P$, $R_3P{=}O$, $R_3P{=}S$, $RPO_2$, $RPS_2$, $RP(O)(OX)_2$, $RP(S)(SX)_2$, $R_2P(O)OX$, $R_2P(S)SX$, $RP(OX)_2$, $RP(SX)_2$, $ROP(OX)_2$, $RSP(SX)_2$, $(RS)_2PSP(SR)_2$, and $(RO)_2POP(OR)_2$, where R is an alkyl or aryl, such as phenyl radical, and X is hydrogen, R, or halide. These compounds include primary, $RPH_2$, secondary, $R_2PH$, and tertiary, $R_3P$, phosphines such as butyl phosphine, the tertiary phosphine oxides, $R_3PO$, such as tributyl phosphine oxide, the tertiary phosphine sulfides, $R_3PS$, the primary, $RP(O)(OX)_2$, and secondary, $R_2P(O)OX$, phosphonic acids such as benzene phosphonic acid, the corresponding sulfur derivatives such as $RP(S)(SX)_2$ and $R_2P(S)SX$, the esters of the phosphonic acids such as dialkyl phosphonate, $(RO)_2P(O)H$, dialkyl alkyl phosphonates, $(RO)_2P(O)R$, and alkyl dialkylphosphinates, $(RO)P(O)R_2$; phosphinous acids, $R_2POX$, such as diethylphosphinous acid, primary, $(RO)P(OX)_2$, secondary, $(RO)_2POX$, and tertiary, $(RO)_3P$, phosphites, and esters thereof such as the monopropyl ester, alkyl dialkylphosphinites, $(RO)PR_2$, and dialkyl alkyphosphinite, $(RO)_2PR$, esters. Corresponding sulfur derivatives may also be employed including $(RS)_2P(S)H$, $(RS)_2P(S)R$, $(RS)P(S)R_2$, $R_2PSX$, $(RS)P(SX)_2$, $(RS)_2PSX$, $(RS)_3P$, $(RS)PR_2$, and $(RS)_2PR$. Examples of phosphite esters include trimethylphosphite, triethylphosphite, diisopropylphosphite, butylphosphite, and pyrophosphites such as tetraethylpyrophosphite. The alkyl groups in the mentioned compounds preferably contain one to four carbon atoms.

Other suitable phosphorus-containing compounds include ammonium hydrogen phosphate, the phosphorus halides such as phosphorus trichloride, bromide, and iodide, alkyl phosphorodichloridites, $(RO)PCl_2$, dialkylphosphorochloridites, $(RO)_2PCl$, dialkylphosphinochloroidites, $R_2PCl$, alkyl alkylphosphonochloridates, $(RO)(R)P(O)Cl$, dialkyl phosphinochloridates, $R_2P(O)Cl$, and $RP(O)Cl_2$. Applicable corresponding sulfur derivatives include $(RS)PCl_2$, $(RS)_2PCl$, $(RS)(R)P(S)Cl$, and $R_2P(S)Cl$.

Particular phosphorus-containing compounds include ammonium phosphate, ammonium dihydrogen phosphate, diammonium hydrogen phosphate, diphenyl phosphine chloride, trimethylphosphite, phosphorus trichloride, phosphoric acid, phenyl phosphine oxychloride, trimethylphosphate, diphenyl phosphinous acid, diphenyl phosphinic acid, diethylchlorothiophosphate, methyl acid phosphate, and other alcohol-$P_2O_5$ reaction products.

Second Molecular Sieve

A second molecular sieve is preferably present when the catalyst is used to crack heavy hydrocarbons feedstocks, such as those having an initial boiling point of about 200° C. When present, the weight ratio of first molecular sieves to second molecular sieve is usually from about 0.005 to about 50, preferably about 0.01 to about 0.1.

The second molecular sieve will usually have a pore size that is larger than the pore size of the first molecular sieve. Preferably the second molecular sieve will have a large pore size, i.e., pore size greater than about 7 Å. Examples of large pore molecular sieves includes AFI, AFR, LTL, VFI, MAZ, MEI, FAU, EMT, OFF, *BEA, and MOR structure type molecular sieves (IUPAC Commission of Zeolite Nomenclature). Examples of specific large pore molecular sieves, include faujasite, mazzite, offretite, zeolite L, VPI-5, SAPO-37, zeolite X, omega, Beta, ZSM-3, ZSM-4, ZSM-18, ZSM-20, MCM-9, MCM-41, MCM-41S, MCM-48. Additional large pore molecular sieves include zeolite Y (U.S. Pat. No. 3,130,007), Ultrastable Y (USY) (U.S. Pat. No. 3,449,070); Rare Earth exchanged Y (REY) (U.S. Pat. No. 4,415,438); Rare Earth exchanged USY (REUSY), Dealuminated Y (DeAl Y) (U.S. Pat. No. 3,442,792; and Ultrahydrophobic Y (UHPY) (U.S. Pat. No. 4,401,556).

The preferred molecular sieve is zeolite Y, more preferably REY, USY or REUSY.

Catalyst Binder

The cracking catalyst will also normally contain one or more binder materials that are resistant to the temperatures and other conditions, e.g., mechanical attrition, which occur during cracking. The binder material may be used to combine all molecular sieves in each catalyst particle. Alternatively, the same or different binder materials can be used to produce separate particles of each molecular sieve.

The matrix may fulfill both physical and catalytic functions. Matrix materials include active or inactive inorganic materials such as clays, and/or metal oxides such as alumina or silica, titania, zirconia, or magnesia. The metal oxide may be in the form of a sol or a gelatinous precipitate or gel.

Naturally occurring clays that can be employed in the catalyst include the montmorillonite and kaolin families which include the subbentonites, and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, catalyst can include a porous matrix material such as silica-alumina, silica-magnesia, silica-zirconia, silica-thoria, silica-beryllia, silica-titania, as well as ternary materials such as silica-alumina-thoria, silica-alumina-zirconia, silica-alumina-magnesia, silica-magnesia-zirconia. The matrix can be in the form of a cogel. A mixture of these components can also be used.

Preferred binder materials include phosphorous-containing alumina (herein after referred to as aluminum phosphate), aluminosilicate, clay, silica sol, clay, zirconia, and titania.

In general, the relative proportions of molecular sieve component(s) and inorganic oxide binder vary widely, with the molecular sieve content ranging from about 1 to about 90 percent by weight, and more usually from about 20 to about 50 weight percent of the catalyst.

Generally, the catalyst particle size will range from about 10 to 300 microns in diameter, with an average particle diameter of about 60 microns. The surface area of the matrix material will be about $\leqq 350\ m^2/g$, preferably 50 to 200 $m^2/g$, more preferably from about 50 to 100 $m^2/g$. While the surface area of the final catalysts will be dependent on such things as type and amount of molecular sieve used, it will usually be less than about 500 $m^2/g$, preferably from about 50 to 300 $m^2/g$, more preferably from about 50 to 250 $m^2/g$, and most preferably from about 50 to 150 $m^2/g$.

Feedstock

The feedstock employed in the process of the invention comprises one or more hydrocarbons having at least 4 carbon atoms, usually at least 5 carbon atoms.

In one preferred embodiment, the feedstock comprises a naphtha having a boiling range of about 25° C. to about 225° C. and preferably a boiling range of 25° C. to 125° C. The naphtha can be a thermally cracked or a catalytically cracked naphtha. Such streams can be derived from any appropriate source, for example, they can be derived from the fluid catalytic cracking (FCC) of gas oils and resids, or they can be derived from delayed or fluid coking of resids. It is preferred that the naphtha streams be derived from the fluid catalytic cracking of gas oils and resids. Such naphthas are typically rich in olefins and/or diolefins and relatively lean in paraffins. Feedstreams which are particularly suitable for producing the relatively high $C_2$, $C_3$, and $C_4$ olefin yields contain primarily paraffins and olefins. Preferred feedstreams are those boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain species such as diolefins, naphthenes, aromatics, and mixtures thereof.

In a further preferred embodiment of the invention, the feedstock comprises a hydrocarbon mixture having an initial boiling point of about 200° C. The hydrocarbon feedstock to be cracked may include, in whole or in part, a gas oil (e.g., light, medium, or heavy gas oil) having an initial boiling point above 200° C., a 50% point of at least 260° C. and an end point of at least 315° C. The feedstock may also include vacuum gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 400° C. must be carried out under vacuum in order to avoid thermal cracking. The boiling temperatures utilized herein are expressed for convenience in terms of the boiling point corrected to atmospheric pressure. Resids or deeper cut gas oils with high metals contents can also be cracked using the process of the invention.

Catalytic Cracking Process

The catalytic cracking process of the invention can operate at temperatures from about 200° C. to about 870° C. under reduced, atmospheric or superatmospheric pressure. The catalytic process can be either fixed bed, moving bed or fluidized bed and the hydrocarbon flow may be either concurrent or countercurrent to the catalyst flow. The process of the invention is particularly applicable to the Fluid Catalytic Cracking (FCC) or moving bed processes such as the Thermofor Catalytic Cracking (TCC) processes. The process is also applicable to Propylene Catalytic Cracking (PCC) processes.

The TCC process is a moving bed process wherein the catalyst is in the shape of pellets or beads having an average particle size of about one sixty-fourth to one-fourth inch. Active, hot catalyst beads progress downwardly cocurrent with a hydrocarbon charge stock through a cracking reaction zone. The hydrocarbon products are separated from the coked catalyst and recovered, whereas the coked catalyst is removed from the lower end of the reaction zone and regenerated. Typically TCC conversion conditions include an average reactor temperature of about 450° C. to about 510° C.; catalyst/oil volume ratio of about 2 to about 7; reactor space velocity of about 1 to about 2.5 vol./hr./vol.; and recycle to fresh feed ratio of 0 to about 0.5 (volume).

The process of the invention is particularly applicable to fluid catalytic cracking (FCC), in which the cracking catalyst is typically a fine powder with a particle size of about 10 to 200 microns. This powder is generally suspended in the feed and propelled upward in a reaction zone. A relatively heavy hydrocarbon feedstock, e.g., a gas oil, is admixed with the cracking catalyst to provide a fluidized suspension and cracked in an elongated reactor, or riser, at elevated temperatures to provide a mixture of lighter hydrocarbon products. The gaseous reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbons from the spent catalyst prior to conveying the latter to a catalyst regenerator unit, an inert stripping gas, e.g., steam, is passed through the catalyst bed where it desorbs such hydrocarbons conveying them to the product recovery zone. The fluidizable catalyst is continuously circulated between the riser and the regenerator and serves to transfer heat from the latter to the former thereby supplying the thermal needs of the cracking reaction which is endothermic.

Typically, FCC conversion conditions include a riser top temperature of about 500° C. to about 650° C., preferably from about 500° C. to about 600° C., and most preferably from about 500° C. to about 550° C.; catalyst/oil weight ratio of about 3 to about 12, preferably about 4 to about 11, and most preferably about 5 to about 10; and catalyst residence time of about 0.1 to about 15 seconds, preferably about 0.2 to about 10 seconds.

The process of the invention is particularly applicable to propylene catalytic cracking (PCC) processes. Typical PCC conversion conditions include temperatures from about 400° C. to about 700° C., preferably from about 525° C. to 600° C., hydrocarbon partial pressures from about 10 to 50 psia, preferably from about 20 to 40 psia; and a catalyst to naphtha (wt/wt) ratio from about 3 to 12, preferably from about 4 to 10, where catalyst weight is total weight of the catalyst composite. It is also preferred that steam be concurrently introduced with the naphtha stream into the reaction zone, with the steam comprising up to about 50 wt. % of the hydrocarbon feed. Also, it is preferred that the naphtha residence time in the reaction zone be less than about 10 seconds, for example from about 0.1 to 10 seconds. The above conditions will be such that at least about 60 wt. % of the $C_{5+}$ olefins in the naphtha stream are converted to $C_{4-}$ products and less than about 25 wt. %, preferably less than about 20 wt. % of the paraffins are converted to $C_{4-}$ products, and that propylene comprises at least about 90 mol %, preferably greater than about 95 mol % of the total $C_3$ reaction products with the weight ratio of propylene/total $C_{2-}$ products greater than about 3.5. It is also preferred that ethylene comprises at least about 90 mol % of the $C_2$ products, with the weight ratio of propylene:ethylene being greater than about 4, and that the "full range" $C_{5+}$ naphtha product is enhanced in both motor and research octanes relative to the naphtha feed. It is within the scope of this invention that the catalysts be precoked prior to introduction of feed in order to further improve the selectivity to propylene. It is also within the scope of this invention that an effective amount of single ring aromatics be fed to the reaction zone to also improve the selectivity of propylene vs. ethylene. The aromatics may be from an external source such as a reforming process unit or they may consist of heavy naphtha recycle product from the instant process.

Preferably, the PCC process is carried out to produce propylene in a propylene to ethylene ratio of at least 4:1 and a propylene to butylene ratio of at least 1:1.

The invention is illustrated by the following non-limiting examples.

EXAMPLE 1

Preparation of MCM-49 Containing 1.4 Weight Percent of Phosphorus (Catalyst A)

A catalyst comprised of MCM-49 containing 1.4 wt % of phosphorus was prepared by adding 3 grams of phosphoric acid (85% by weight) to a slurry containing 400 grams of distilled water and 50 grams of H-MCM-49. The mixture was refluxed for 2 hours and then filtered while hot. Next, the filter cake was dried and calcined at 1000° F. for 2 hours. Analysis by ICP of the calcined phosphorous-containing MCM-49 determined that it contained 81.1 wt % of $SiO_2$, 7.73 wt % of $Al_2O_3$, 0.01 wt % of sodium, and 1.4 wt % of phosphorus. The surface area was 516 $m^2/g$ and the alpha value was 400.

Next, the calcined phosphorous-containing MCM-49 was steamed at a pressure of one atmosphere in a horizontal quartz tube for 2 hours at 1400° F. with 100% steam. The resulting MCM-49 had an alpha value of 44 and will be referred to as Catalyst A.

EXAMPLE 2

Preparation of Silica Bound MCM-49 Containing 0.94 Weight Percent of Copper (Catalyst B)

Silica-bound MCM-49 containing copper was prepared by ball-milling a slurry containing 258 grams of H-MCM-49 (90% by weight of solids), 42.1 grams of copper acetate, and 1192 grams of distilled water for 16 hours. The solid content of the slurry after milling was determined by Thermal Gravity Analysis (TGA) to be 18.7%. An amount of 1240 grams of the slurry was mixed under constant homogenization with 568 grams of silica sol [Nalco-1034A (34% by weight SiO2)] and 439 grams of hydrite clay (85.6% by weight of solids). The solid content of the mixture was determined to be 35.5% by weight as measured by TGA. The viscosity was determined to be 8500 cps as measured on a Brookfield viscometer. The mixture was spray-dried in a Bowen Spray Dryer to form spherical particles. The spray-dried product was calcined at 1000° F. for 2 hours. Analysis by ICP of the calcined product determined that it contained 70.5 wt % of $SiO_2$, 22.4 wt % of $Al_2O_3$, 0.055 wt % of sodium, and 0.94 wt % of copper. Next, the product was steamed at 1400° F. for 2 hours in a horizontal quartz tube with 100% steam at a pressure of one atmosphere. The alpha value was determined to be 23. The copper-containing, silica-bound MCM-49 product will be referred to as Catalyst B.

EXAMPLE 3

Preparation of MCM-49 Containing 3.5 Weight Percent of Copper (Catalyst C)

An amount of 0.243 g of cupric fluoride was dissolved in 10 ml of deionized water to form a solution. Next, 1.0 grams of MCM-49 was then added to the 2.33 mls of the cupric fluoride solution. The mixture was stirred well and then allowed to stand for 16 hours at room temperature. Next, the material was dried at 120° C. for 2 hours, and then calcined at 550° C. for 10 hours. The copper impregnated MCM-49 was then steamed in a horizontal quartz tube for 2 hours at 1400° F. in a pressure of one atmosphere with 100% steam. The resulting MCM-49 product will be referred to as Catalyst C.

EXAMPLE 4

Preparation of ITO-13 (Catalyst D)

A catalyst comprised of ITQ-13 was steamed in a horizontal quartz tube for 2 hours at 1400° F. in one atmosphere pressure with 100% steam. The resulting ITQ-13 product will be referred to as Catalyst D.

EXAMPLE 5

Preparation of ITO-13 Containing 1.6 Weight Percent of Copper (Catalyst E)

An amount of 0.110 g of cupric fluoride was dissolved in 10 ml of deionized water to form a solution. Next, 1.0 grams of ITQ-13 was then added to the 2.33 mls of the cupric fluoride solution. The mixture was stirred well and then allowed to stand for 16 hours at room temperature. Next, the material was dried at 120° C. for 2 hours, and then calcined at 550° C. for 10 hours. The copper exchanged ITQ-13 was steamed in a horizontal quartz tube for 2 hours at 1400° F. in one atmosphere pressure with 100% steam. The resulting ITQ-13 product will be referred to as Catalyst E.

EXAMPLE 6

Catalysts A through E were evaluated in catalytic cracking in a fixed fluidized bed reactor. The feed used in the tests was a vacuum gas oil (VGO). The properties of the VGO are set forth below on Table 1.

TABLE 1

| | |
|---|---|
| Specific Gravity, g/ml | 0.9118 |
| Mean Avg. Boiling Pt., ° F. | 836.5 |
| Carbon, Wt. % | 85.95 |
| Hydrogen, Wt. % | 12.43 |
| Sulfur Wt. % | 0.988 |
| Nitrogen wppm | 900 |
| Nickel wppm | 0.30 |
| Vanadium wppm | 0.34 |
| Iron wppm | 2.75 |

The tests were carried out in fixed fluidized bed reactor at a temperature of 1035° F. (557° C.). The feed was injected into the bottom of the fixed fluidized bed reactor at a rate of 0.02 g/s. Catalysts A-E were tested as additives for propylene generation in FCC by blending in the catalysts with USY cracking catalyst. In total, nine grams of catalyst was used for each test. The gaseous products were collected by displacing an aqueous solution and were analyzed by online gas chromatography. Coked catalyst was stripped by $N_2$ to remove residual hydrocarbon products. The stripped catalyst was regenerated in-situ at 1250° F. (677° C.) to burn off coke. Catalyst-to-oil ratio was varied between 3 and 9, to obtain 70 to 80% feed conversion. Data at 76 wt % conversion to 430° F. lighter products are listed in Table 2. Propylene selectivity is defined as the mole percent of propylene in the $C_4$ and lighter product stream.

TABLE 2

| | Catalyst | | | | | |
|---|---|---|---|---|---|---|
| | A | B | C | C | D | E |
| Wt. % of Additive | 1 | 4 | 1 | 2 | 1 | 1 |
| $C_3^=$ Yield | 6.74 | 8.52 | 7.51 | 8.55 | 6.62 | 8.29 |
| Molar ratio of $C_3^=/C_4^=$ | 0.248 | 0.285 | 0.261 | 0.279 | 0.245 | 0.285 |

The tests show that the unbound, copper-containing MCM-49 catalyst and silica-bound, copper-containing MCM-49 catalyst had higher activity which resulted in higher propylene yield than MCM-49 catalyst without copper (phosphorous modified MCM-49). The catalysts had been steamed at 1400° F. (760° C.) for 2 hours. The selectivity of the unbound, copper-containing MCM-49 catalyst and silica-bound, copper-containing MCM-49 catalyst was also higher at 0.261-0.285, which is significantly higher than the selectivity shown by the MCM-49 catalyst without copper. Similarly, the tables show the copper-containing ITQ-13 to be more active and selective towards propylene than the ITQ-13 without copper, after both catalysts were steamed at 1400° F. (760° C.) for 2 hours.

EXAMPLE 7

Preparation of Steamed MCM-49 Without Copper (Catalyst F)

MCM-49 was steamed with 100% steam at 1 atmospheric pressure in a flow-through steamer at 760° C. for 2 hours. The resulting product will be referred to as Catalyst F.

EXAMPLE 8

Preparation of Steamed, Copper-Containing MCM-49 (Catalyst G)

An amount of 0.129 g of cupric fluoride was dissolved in 50 ml of deionized water to form a solution. Next, 3.0 grams of MCM-49 was then added to the solution. The mixture was stirred well for 8 hours at a temperature of 100° C. with reflux of the solution. The mixture was then filtered to recover the copper exchanged MCM-49 containing ion exchanged Cu. Next, the material was washed with deionized water, dried at 120° C. for 2 hours, and then calcined at 540° C. for 8 hours. The calcined, copper exchanged MCM-49 was then steamed in a flow-through steamer at 760° C. for 2 hours with 100% steam at 1 atmospheric pressure. The resulting product will be referred to as Catalyst G.

EXAMPLE 9

Preparation of Steamed, MCM-49, Twice Exchanged with Copper (Catalyst H)

An amount of 0.029 g of cupric fluoride was dissolved in 50 ml deionized water to form a solution. Next, 1.0 grams of MCM-49 was then added to the copper fluoride solution. The mixture was then stirred well for 8 hours at a temperature of 100° C. with reflux of the solution. The mixture was filtered to recover the copper exchanged MCM-49. The material was then washed with deionized water, dried at 120° C. for 2 hours, and calcined at 540° C. for 8 hours.

Next, an amount of 0.007 g of cupric fluoride was dissolved in 25 ml deionized water to form a solution. Next, 0.5 grams of the copper exchanged MCM-49 was added to the cupric fluoride solution. The mixture was then stirred well for 8 hours at a temperature of 100° C. with reflux of the solution. The mixture was filtered to recover the copper exchanged MCM-49, twice exchanged. The material was then washed with deionized water, dried at 120° C. for 2 hours, and calcined at 540° C. for 8 hours. The calcined material was steamed with 100% steam at 1 atmospheric pressure in a flow-through steamer at 760° C. for 2 hours. The resulting product will be referred to as Catalyst H.

EXAMPLE 10

Preparation of Steamed, MCM-49, Exchanged with Both Copper and Zirconium (Catalyst I)

An amount of 0.215 g of cupric fluoride was dissolved in 250 ml deionized water to form a solution. Next, 5.0 grams of MCM-49 was then added to the cupric fluoride solution. The mixture was stirred well for 8 hours at 100° C. with reflux of the solution. The mixture was then filtered to recover the copper exchanged MCM-49. The material was washed with deionized water, dried at 120° C. for 2 hours, and calcined at 540° C. for 8 hours.

Next, an amount of 0.064 g of zirconium tetrafluoride was dissolved in 50 ml deionized water to form a solution. An amount of 1.0 gram of the copper exchanged MCM-49 added to the zirconium tetrafluoride solution. The mixture was stirred well at 100° C. for 8 hours with reflux of the solution and then filtered to recover the copper/zirconium exchanged MCM-49. The material was washed with deionized water, dried at 120° C. for 2 hours, and then calcined at 540° C. for 8 hours. The calcined copper/zirconium exchanged MCM-49 was then steamed with 100% steam at 1 atmosphere in a flow-through steamer at 760° C. for 2 hours. pressure. The resulting product will be referred to as Catalyst I.

EXAMPLE 11

Catalysts F through I were evaluated in catalytic cracking processes. The tests were carried out at 575° C. and feed contained 50 weight percent of 1-hexane and 50 weight percent of hexane by weight. Feed rate was kept constant at 0.36 g/min and the WHSV was either 600 or 2400 $hr^{-1}$. The results of the tests are shown below in Table 3.

TABLE 3

| Catalyst | F | G | H | I |
|---|---|---|---|---|
| WHSV, Hr-1 | 600 | 600 | 2400 | 2400 |
| C4– Conversion | 11.4 | 36.6 | 38.4 | 41.1 |
| Ethylene | 1.4 | 2.2 | 2.1 | 2.8 |
| Propylene | 6.2 | 28.3 | 29.7 | 29.7 |
| Butylene | 2.4 | 4.7 | 5.1 | 6.2 |
| C1-C4 Lt Stats | 1.5 | 1.4 | 1.5 | 2.3 |
| C3=/C4– Selectivity | 48.2 | 76.1 | 76.1 | 70.3 |

The tests show that the copper-containing MCM-49 catalyst (Catalysts G through I) had higher activity which resulted in higher propylene yield than MCM-49 catalyst without copper (Catalyst F).

We claim:

1. A catalytic cracking process comprising contacting a feedstock containing hydrocarbons having at least 4 carbon atoms with a hydrothermally stable catalyst, said catalyst comprising a molecular sieve selected from the group consisting of MCM-22, MCM-36, MCM-49, and MCM-56 and an effective amount of a stabilization metal selected from copper, and mixtures of copper and zirconium exchanged into said molecular sieve, said contacting being carried out under catalytic cracking conditions, whereby $C_3$ olefins are selectively produced on a molar basis relative to $C_4$ and lighter product stream, with minimal amounts of methane and aromatics being produced.

2. The process recited in claim 1, wherein the stabilization metal-containing molecular sieve contains at least 0.5 weight percent of the stabilization metal cations based on the weight of said molecular sieve.

3. The process recited in claim 1, wherein the stabilization metal-containing molecular sieve further comprises a phosphorus-containing compound.

4. The process recited in claim 1, wherein said catalyst further comprises a binder.

5. The process recited in claim 4, wherein said binder is selected from the group consisting of aluminum phosphate, aluminosilicate, clay, silica sol, clay, zirconia, and titania, and mixtures thereof.

6. The process recited in claim 4, wherein said binder is selected from the group consisted of clays, alumina, silica, titania, zirconia, magnesia, silica-alumina, silica-magnesia, silica-zirconia, silica-thoria, silica-alumina-zirconia, silica-alumina-magnesia, silica-magnesia-zirconia, and mixtures thereof.

7. The process recited in claim 2, wherein said stabilization metal is incorporated into the stabilization metal-containing molecular sieve by ion exchange or incipient wetness.

8. The process recited in claim 7, wherein the ion exchange treatment is carried out multiple times.

9. The process recited in claim 1, wherein said stabilization metal is copper.

10. The process recited in claim 1, wherein said stabilization metal is copper and zirconium.

11. The process recited in claim 1, wherein said catalyst further comprises a second molecular sieve having a pore size that is larger than the pore size of the first molecular sieve.

12. The process recited in claim 11, wherein said second molecular sieve has a structure selected from the group consisting of VFI, *BEA, and FAU.

13. The process recited in claim 11, wherein said second molecular sieve is selected from the group consisting of Beta, VPI-5, Zeolite X, Zeolite Y, ultrastable Y, ultrahydrophobic Y, and dealuminated X.

14. The process recited in claim 11, wherein the product of said catalytic cracking process contains at least 50 percent by weight of $C_3$ olefins based on the total weight of $C_3$ and $C_4$ olefins produced by said process.

15. The process recited in claim 1, wherein said feedstock comprises a naphtha having a boiling range of 250° C. to 225° C.

16. The process recited in claim 1, wherein said feedstock is selected from the group consisting of vacuum gas oils, thermal oils, residual oils, cycle stocks, whole top crudes, tar sand oils, shale oils, synthetic fuels, and heavy hydrocarbon fractions derived from the destructive hydrogenation of coal, tar, pitches, or asphalts.

17. The process recited in claim 11, wherein said feedstock is selected from the group consisting of vacuum gas oils, thermal oils, residual oils, cycle stocks, whole top crudes, tar sand oils, shale oils, synthetic fuels, and heavy hydrocarbon fractions derived from the destructive hydrogenation of coal, tar, pitches, or asphalts.

18. The process recited in claim 11, wherein said catalytic cracking conditions include a temperature of 500 to 650° C.

19. The process recited in claim 2, wherein the stabilization metal-containing molecular sieve is MCM-49.

20. The process recited claim 11, wherein the stabilization metal-containing molecular sieve and said second molecular sieve are present in said catalyst in an amount such that the weight ratio of molecular sieve to second molecular sieve is in the range from about 0.01 to about 10.

21. The process recited in claim 11, wherein the particles of the stabilization metal-containing molecular sieve and said second molecular sieve has an average crystal size in the range from about 0.1 to about 3 micrometers.

22. The process recited in claim 15, wherein said feedstock is a thermally or catalytically cracked naphtha boiling in the naphtha range and containing from about 5 wt. % to about 35 wt. % paraffins, and from about 15 wt. % to about 70 wt. % olefins.

23. The process recited in claim 15, wherein the catalytic cracking conditions include a feed residence time in the reaction zone of less than about 10 seconds, temperatures ranging from about 400° C. to about 700° C.; hydrocarbon partial pressures from about 10 to 50 psia; and a catalyst to feed (wt/wt) ratio from about 3 to 12; wherein catalyst weight is total weight of said catalytic cracking catalyst composite.

24. The process recited in claim 11, wherein said hydrocarbon has an initial boiling point above 200° C., a 50% point of at least 260° C. and an end point of at least 315° C.

25. The process recited in claim 11, wherein the product of said catalytic cracking process contains at least 50 percent by weight of $C_3$ olefins based on the total weight of the propylene and butylene produced by the process.

26. The process recited in claim 15, wherein said process is carried out to produce propylene in a propylene to ethylene ratio of at least 4:1 and a propylene to butylene ratio of at least 1:1.

27. The process recited in claim 11, further comprising the steps of: (a) separating the propylene; and (b) polymerizing or co-polymerizing the separated propylene.

28. The process recited in claim 15, further comprising the steps of: (a) separating the propylene; and (b) polymerizing or co-polymerizing the separated propylene.

* * * * *

UNITED STATES PATENT AND TRADEMARK OFFICE

CERTIFICATE OF CORRECTION

PATENT NO. : 7,615,143 B2
APPLICATION NO. : 10/903152
DATED : November 10, 2009
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 483 days.

Signed and Sealed this

Nineteenth Day of October, 2010

David J. Kappos

David J. Kappos
*Director of the United States Patent and Trademark Office*